US005321475A

United States Patent [19]

Horiuchi et al.

[11] Patent Number: 5,321,475

[45] Date of Patent: Jun. 14, 1994

[54] COLOR IMAGE FORMING APPARATUS WHICH ACCELERATES OR DECELERATES THE DEVELOPING SLEEVES AT A CONSTANT RATE

[75] Inventors: Yoshimine Horiuchi, Yokohama; Yoshihiro Sakai, Tokyo; Hideya Furuta, Yokohama, all of Japan

[73] Assignee: Ricoh Company, Ltd., Tokyo, Japan

[21] Appl. No.: 10,303

[22] Filed: Jan. 28, 1993

[30] Foreign Application Priority Data

Jan. 28, 1992 [JP] Japan ..... 4-013371
Sep. 2, 1992 [JP] Japan ..... 4-234981

[51] Int. Cl.[5] ..... G03G 15/09

[52] U.S. Cl. ..... 355/253; 118/645; 118/658; 355/326

[58] Field of Search ..... 355/251, 253, 259, 326–328; 118/645, 653, 656–658

[56] References Cited

U.S. PATENT DOCUMENTS 4,857,954 8/1989 Abuyama et al. ..... 118/657 X
4,860,053 8/1989 Yamamoto et al. ..... 355/251 X
4,990,968 2/1991 Kusuda ..... 355/326

FOREIGN PATENT DOCUMENTS 0055372 4/1980 Japan ..... 355/326
0119925 1/1985 Japan ..... 355/251
0112181 5/1987 Japan ..... 355/259

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A color image forming apparatus has a plurality of developing units each including a developing sleeve and storing a developer of particular color. The developing sleeve is located to face a photoconductive element or similar image carrier. When the supply of the developer from the developing sleeve to the image carrier begins or ends, a magnet brush formed on the sleeve by the developer is slowly brought into or out of contact with the image carrier. As a result, a load acting on the image carrier due to the brush contacting it is slowly applied and cancelled. This eliminates changes in the moving speed of the image carrier and thereby insures desirable image quality.

16 Claims, 6 Drawing Sheets

COLOR IMAGE FORMING APPARATUS WHICH ACCELERATES OR DECELERATES THE DEVELOPING SLEEVES AT A CONSTANT RATE

BACKGROUND OF THE INVENTION

The present invention relates to a color copier, color printer or similar color image forming apparatus.

It is a common practice with a color image forming apparatus to prevent the mixture of colors by causing each developing unit to move into and out of contact with an image carrier independently of the others, causing only a developer carrier to move in a reciprocating motion, or selectively rotating a developing sleeve forward or backward. In an apparatus of the type moving each developing unit into and out of contact with an image carrier as mentioned above, it is likely that the image carrier receives an instantaneous impact load in the event when a plurality of toner images of different colors are combined on the image carrier or when a toner image is transferred to a transfer body. Then, the load acting on the image carrier changes to bring about the misregistration of toner images of different colors and the dislocation of the toner image, noticeably degrading the image quality. To eliminate this problem, use may be made of an eccentric cam for causing the load to act on the image carrier slowly when each developing unit is brought into and out of contact with the image carrier independently of the others, as proposed in the past.

Another conventional color image forming apparatus has an image carrier for forming an electrostatic latent image thereon, a plurality of developing units facing the image carrier and each storing a developer of particular color, and driving means for selectively rotating a developing sleeve included in each developing unit forward or backward to form or cancel a magnet brush of a developer. This type of apparatus is not provided with any measure against the changes in the load acting on the image carrier and, therefore, suffers from the misregistration of color components and the dislocation of a composite image.

SUMMARY OF THE INVENTION

It is, therefore, an object of the present invention to provide a color image forming apparatus which prevents image quality from being lowered by changes in a load acting on an image carrier due to the formation and cancellation of a magnet brush, i.e., the reversible rotation of a developing sleeve.

A color image forming apparatus of the present invention comprises an image carrier for electrostatically forming a latent image thereon, a plurality of developing units each facing the image carrier and storing a developer of particular color, a drive control circuit for selectively forming or cancelling a brush of a developer on each of the plurality of developing units by selectively rotating a developing sleeve of the developing unit forward or backward. The drive control circuit causes the developing sleeve to start rotating slowly when the brush is to be formed on the developing sleeve.

In a preferred embodiment, the drive control circuit causes the developing sleeve to stop rotating slowly with the brush existing on the developing sleeve.

In another preferred embodiment, the drive control circuit causes the developing sleeve to stop rotating slowly when the brush on the developing sleeve is to be cancelled.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
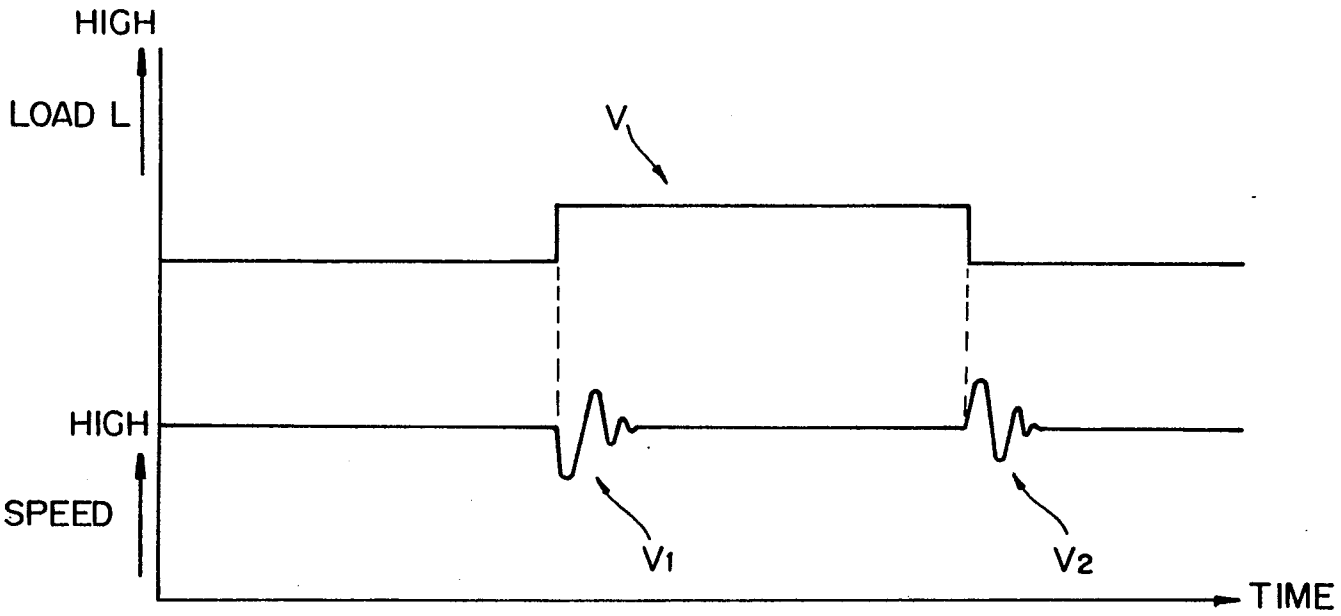
Fig. 1 PRIOR ART
FIG. 1 is a timing chart indicative of a relation between sharp changes in a load being exerted by a developing sleeve on a photoconductive drum and corresponding changes in the speed of the drum.

Referring to FIG. 1 of the drawings, there is shown how, in a conventional color image forming appartus, the speed of a photoconductive element or similar image carrier changes with the change in the load being exerted by a developing sleeve of a developing unit on the image carrier. As shown, when the load L acting on the image carrier undergoes a sharp change V, the speed S of the image carrier changes. Specifically, changes v1 and v2 occur in the speed S at the beginning and the end of the change V1, respectively. The changes v1 and v2 in the speed S of the image carrier brings colors out of register with each other and dislocates an image.

A color image forming apparatus embodying the present invention will be described hereinafter. To begin with, the construction and operation of a color image forming apparatus which is a specific form of an image forming apparatus embodying the present invention will be described.

Figure 2:
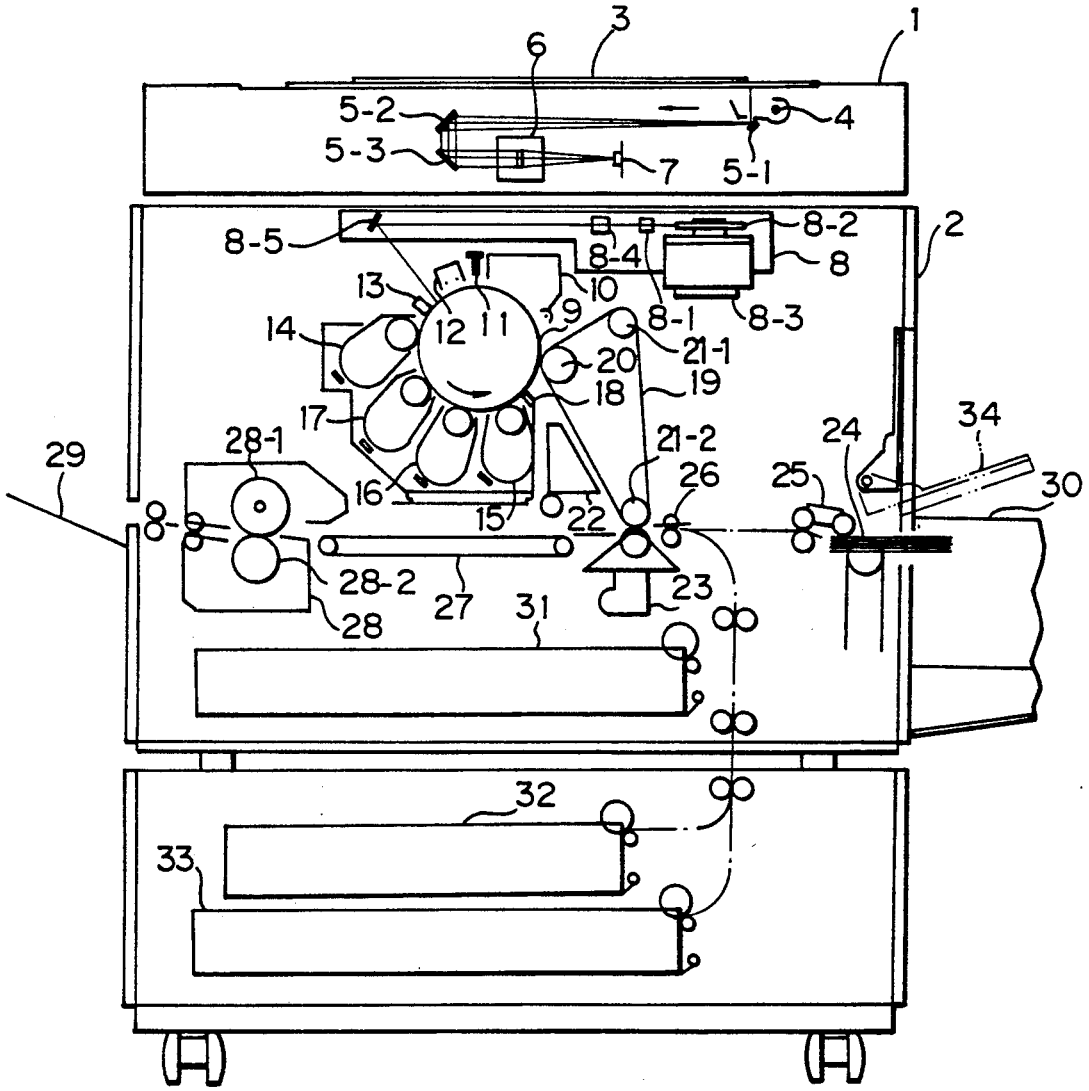
FIG. 2 is a section showing a color image forming apparatus embodying the present invention.

As shown in FIG. 2, the color image forming apparatus is generally made up of an image scanner 1 and a color image recorder 2. The color image scanner, or image reading unit, 1 illuminates a document 3 by a lamp 4 and focuses the resulting reflection from the document 3 onto a color image sensor 7 via a group of mirrors 5-1, 5-2 and 5-3 and a lens 6. As a result, image information of the document are separated into, for example, blue (B), green (G) and red (R) color components and then converted to corresponding electric image signals B, G and R. In the illustrative embodiment, an image processing section, not shown, transforms the image signals B, G and R to black (BK), cyan (C), magenta (M) and yellow (Y) color signals on the basis of the intensity levels of the signals B, G and R. The color image recorder, or color printer as referred to hereinafter, 2 prints the BK, C, M and Y components to produce a color copy. Specifically, in the color scanner 1, the illumination and mirror unit shown in FIG. 2 scans the document to the left as indicated by an arrow in response to a scanner start signal which is synchronous to the operation of the color printer 2. Such a unit generates image data of one color every time it scans the document. The scanning movement is repeated four consecutive times to generate image of four different colors in sequence. Every time image data of one color is generated, the color printer 2 produces a corresponding toner image. Consequently, four visible images are combined to complete a full-color image.

Figure 3:
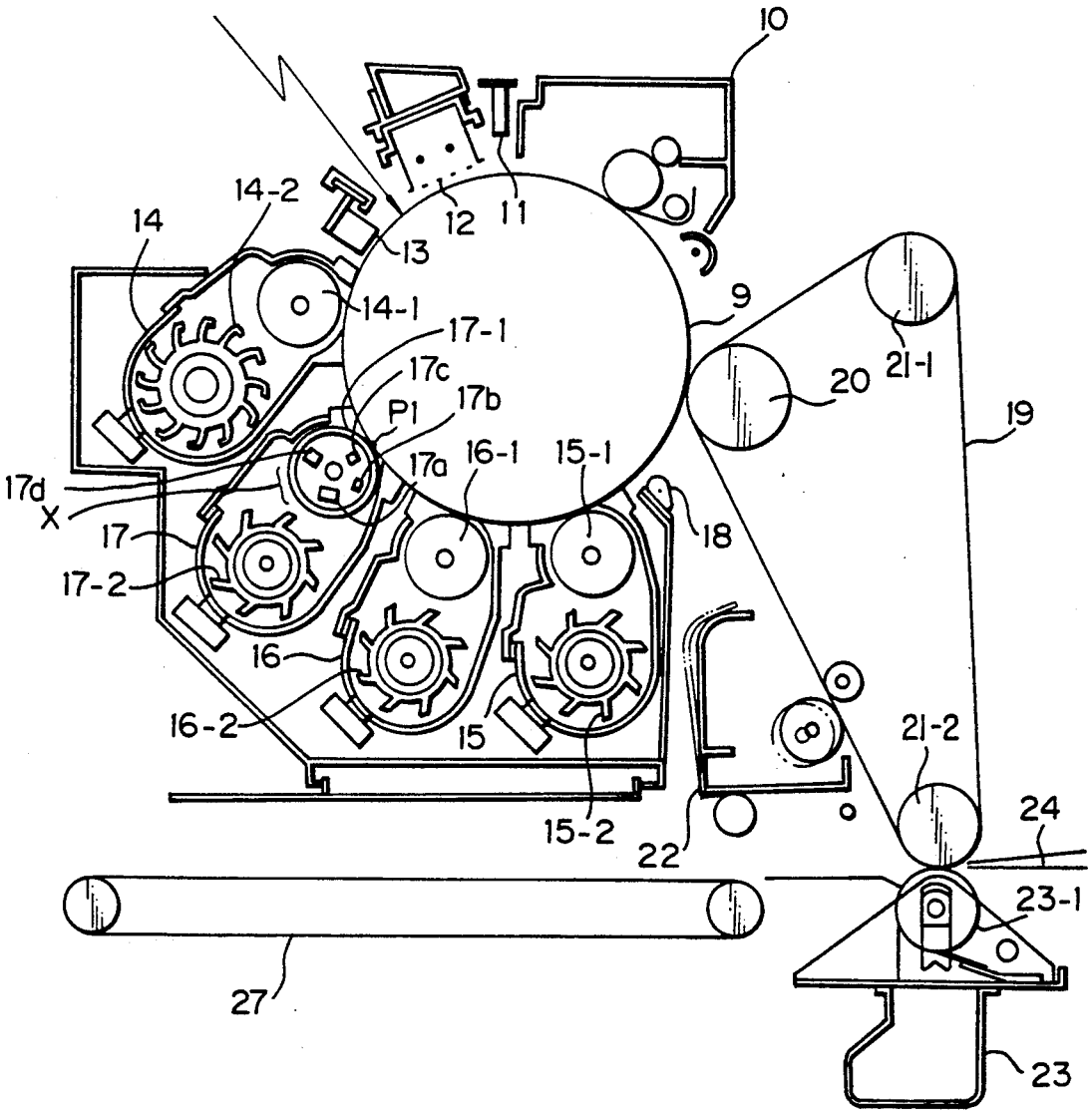
FIG. 3 is a section showing a specific construction of an image forming section included in the embodiment.

Specifically, the color printer 2 includes an optical writing unit 8 which converts the color image data from the color scanner 1 to an optical signal and then optically writes it on a photoconductive drum 9. As a result, a latent image is electrostatically formed on the drum 9. The writing unit 8 has a laser 8-1, a laser driver, not shown, a polygonal mirror 8-2, a motor 8-3 for rotating the mirror 8-2, an f-theta lens 8-4, and a mirror 8-5. The drum 9 is rotated counterclockwise as indicated by an arrow in the figure. Arranged around the drum 9 are a cleaning unit (including a precleaning discharger) 10, a discharge lamp 11, a charger 12, a potential sensor 13, a BK developing unit 14, a C developing unit 15, an M developing unit 16, a Y developing unit 17, a reference density pattern sensor 18, an intermediate image transfer belt 19, and so forth. As shown in FIG. 3, the developing units 14-17 have respectively developing sleeves 14-1, 15-1, 16-1 and 17-1, and paddle wheels 14-2, 15-2, 16-2 and 17-2. The sleeves 14-1 to 17-1 are each rotated with a toner brush, which will be described, contacting the surface of the drum 9, thereby developing the latent image. The paddle wheels 14-2 to 17-2 are each rotated to scoop up the associated developer while agitating it.

In a standby state, all of the four developing units 14-17 maintain toner brushes on the associated sleeves 14-1 to 17-1 in a non-developing condition. In the following description, it is assumed that BK, C, M and Y image components are sequentially developed in this order, although such an order is not limitative.

On the start of a copying operation, the color scanner 1 starts reading BK image data at a predetermined time. The BK image data is written on the drum 9 by a laser beam to form a corresponding latent image or BK latent image as referred to hereinafter. This is also true with C, M and Y latent images. Before the leading edge of the BK image arrives at the developing position of the BK developing unit 14, the sleeve 14-1 of the unit 14 begins to rotate to form a toner brush thereon at a developing position. Then, the sleeve 14-1 develops the BK latent image by a BK toner. As soon as the trailing edge of the BK latent image moves away from the BK developing position, the toner brush on the sleeve 14-1 is cancelled. This is completed at least before the leading edge of a C latent image reaches the developing unit 14. To cancel the toner brush on the sleeve 14-1, the rotation of the sleeve 14-1 is reversed.

A BK toner image formed on the drum 9 by the above procedure is transferred to the intermediate image transfer belt 19. Specifically, a predetermined bias is applied to a bias roller 20 while the drum 9 and belt 19 are held in contact, thereby effecting the image transfer from the drum 9 to the belt 19. The BK, C, M and Y toner images sequentially formed on the drum 9 are transferred to the belt 19 one above the other to complete a four-color image. Subsequently, the four- or full-color image is transferred from the belt 19 to a recording medium, e.g., a paper sheet.

At a predetermined time, the color scanner 1 having read the BK image data begins to read C image data. A laser beam writes the C image data on the drum 9 to form a C latent image. After the trailing edge of the BK latent image has moved away from the developing position of the C developing unit 15 and before the leading edge of the C latent image arrives at the unit 15, the sleeve 15-1 of the unit 15 starts rotating to form a toner brush thereon at a developing position. As a result, the C latent image is developed by a C toner. As soon as the trailing edge of the C latent image moves away from the C developing position, the toner brush on the sleeve 15-1 is cancelled. This is also completed before the leading edge of an M latent image reaches the developing unit 15.

How to read M data and Y data, form M and Y latent images and then develop them will not be described since they are essentially identical with the above-described procedure.

The intermediate transfer belt 19 is passed over the bias roller 20 and driven rollers 21-1 and 21-2 and rotated by a motor, not shown. A belt cleaning unit 22 cleans the surface of the belt 19 in contact with the belt 19. A mechanism is provided for maintaining the cleaning unit 22 spaced apart from the belt 19 while the transfer of the second, third and fourth colors to the belt 19 is under way after the first color, i.e., BK. A transfer unit 23 is usually spaced apart from the surface of the belt 19. At the time when the full-color image formed on the belt 19 should be bodily transferred to a paper sheet 24, the transfer unit 23 is urged against the belt 19 by a mechanism, not shown. At the same time, a predetermined bias voltage is applied to a bias roller 23-1. As a result, the full-color image is transferred from the belt 19 to the paper sheet 24.

The paper sheet 24 is fed by a pick-up roller 25 and a register roller 26 at such a timing that the leading edge of the full-color image carried on the belt 19 reaches an image transfer position.

After the tranfer of the first or BK toner image to the belt 19, the belt 19 may be moved in any one of conventional modes. Typical of the conventional modes is a constant speed reciprocation mode in which the belt 19 continuously moves at a constant speed in a reciprocating motion even after the transfer of the the BK image. The next toner image, i.e., C toner image is formed on the drum 9 such that the leading edge thereof arrives at the image transfer position when the leading edge of the BK tonerimage on the belt 19 arrives there. At the image transfer position, the belt 19 remains in contact with the drum 9. As a result, the C toner image is transferred to the belt 19 in accurate register with the BK toner image. Such a movement of the belt 19 is repeated to transfer the M and Y toner images to the belt 19 in succession. After the transfer of the Y image or last image, the belt 19 is continuously moved forward to transfer the resulting full-color image to the paper sheet 24.

The paper sheet 24 carrying the full-color image thereon is transported to a fixing unit 28 by a transporting unit 27. The fixing unit 28 has a fixing roller 28-1 whose temperature is controlled to a predetermined temperature and a pressing roller 28-2 pressed against the fixing roller. While the paper sheet 24 moves through between the two rollers, the toner image is fixed on the sheet 24 by heat. Thereafter, the paper sheet 24 is driven out to a tray 29 as a full-color copy.

After the image transfer from the drum 9 to the belt 19, the drum 9 is cleaned by the cleaning unit 10 and then uniformly discharged by the discharge lamp. The belt 19 from which the image has been transferred to the paper sheet 24 is cleaned by the belt cleaning unit 22. Sheet cassettes 30, 31, 32 and 33 are each loaded with paper sheets of particular size, and one of them is selected on an operation panel, not shown. A paper sheet from designated one of the cassettes 30–33 is fed to the register roller 26 at a predetermined time. The reference numeral 34 designates an extra tray for OHP sheets and manual sheet insertion.

while the foregoing description has concentrated on a four-color copy mode, a three-color or a two-color copy is, of course, obtainable if the procedure described above is repeated a corresponding number of times.

A mechanism for selectively forming or cancelling the toner brush will be described with reference to FIG. 3. To begin with, the principle of the formation of the toner brush will be described. As shown in FIG. 3, the developing sleeve 17-1, for example, has magnets 17*a*–17*d* fixed in place thereinside. The magnet 17*a* attracts the developer conveyed by the paddle wheel, or developer conveying member, 17-2 onto the surface of the sleeve 17-1. The magnet 17*b* transports the developer on the sleeve 17-1 to a developing position P1. Located at the developing position P1, the magnet 17*c* causes the developer to form a toner brush or magnet brush. Further, the magnet 17*d* attracts the developer remaining on the sleeve 17-1 to prevent it from being scattered around. The magnets 17*a* and 17*d* are spaced apart by a greater distance than the magnets 17*b* and 17*c*. When the sleeve 17-1 is rotated forward or clockwise as viewed in FIG. 3, the developer is sequentially scooped up by the magnets 17*c*, 17*b* and 17*a* in this sequence and collected, after development, in a region X where no magnetism acts thereon. To cancel the toner brush, the sleeve 17-1 is reversed, i.e., rotated counterclockwise with the result that the developer at and around the developing position P1 is sequentially collected by the magnets 17*c*, 17*b* and 17*a* in this order. Part of the developer attracted by the magnet 17*a* is collected without being attracted by the magnet 17*d* due to the region X. Consequently, the developer is not brought to the position P1 any further. Such a procedure also applies to the other developing units.

While development using the C, M or Y toner is under way, the toner would be mixed with a toner of another color if the latter were left on the associated sleeve. For example, if the Y toner is left on the Y sleeve 15-1 while C development is under way, then, the Y toner will be mixed with the C toner. To eliminate this problem, each sleeve is brought to a stop and then reversed at the end of the associated development so as to cancel the toner brush or magnet brush. As a result, the tip of the brush is spaced apart from the drum 9 to reduce the load acting on the drum 9.

Figure 4:
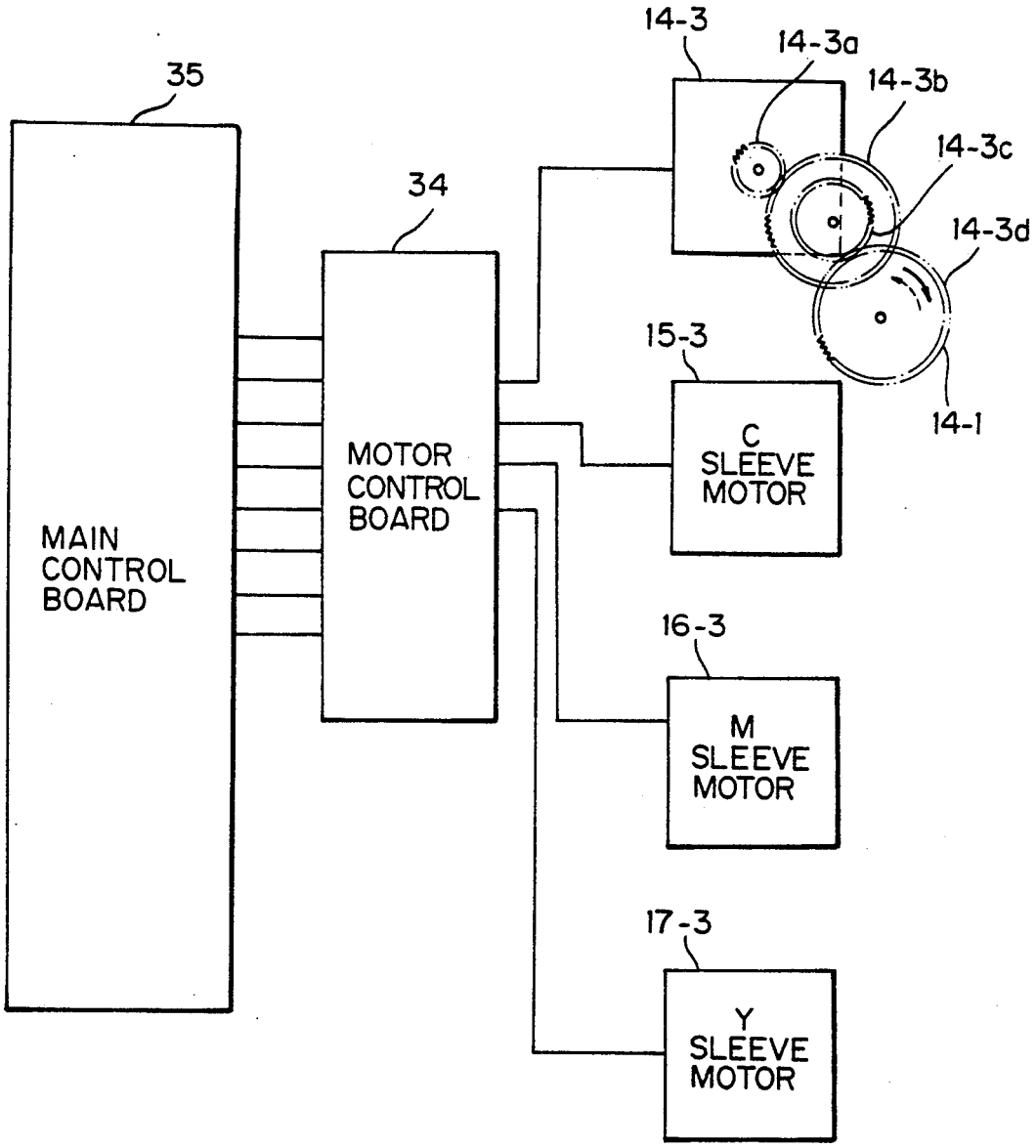
FIG. 4 is a block diagram schematically showing a control system also included in the embodiment.

At the beginning of development, the sleeve which is stopped is caused to rotate forward or clockwise. Then, the developer is brought to the developing position to form a brush. Since the tip of the brush contacts the drum 9, the load acting on the drum 9 increases. To implement such forward and reverse rotations of the sleeves, drive means each being associated with one of the sleeves are driven by respective motors, as shown in FIG. 4. As shown, the sleeves 14-1, 15-1, 16-1 and 17-1 are driven by motors 14-3, 15-3, 16-3 and 17-3, respectively. Gearings intervening between the motors and the associated sleeves are identical and will be described by taking the BK developing unit 14 as an example.

A gear 14-3*a* is mounted on the output shaft of the motor 14-3. The rotation of the gear 14-3*a* is transmitted to the sleeve 14-1 via idler gears 14-3*b*, 14-3*c* and 14-3*d*. The gears 14-3*a* to 14-3*d* constitute a speed reduction mechanism, i.e., the rotation of the motor 14-3 is reduced in speed before it reaches the sleeve 14-1. In FIG. 4, a solid arrow and a phantom arrow indicate respectively the clockwise rotation and the counterclockwise rotation of the sleeve 14-1. The motors 14-3 to 17-3 are connected to a motor control board 34. A main control board 35 controls the entire process. In response to a command from the main control board 35, the motor drive board 35 starts and stops rotating each motor, switches over the direction of rotation of each motor, and controls the timings thereof.

If the load acting on the drum 9 sharply changes when the magnet brush is formed or cancelled, the noticeable changes v1 and v2 shown in FIG. 1 will occur in the speed S of the drum 9 and degrade the image quality. In such a case, the illustrative embodiment causes the load acting on the drum 9 to change slowly.

Figure 5:
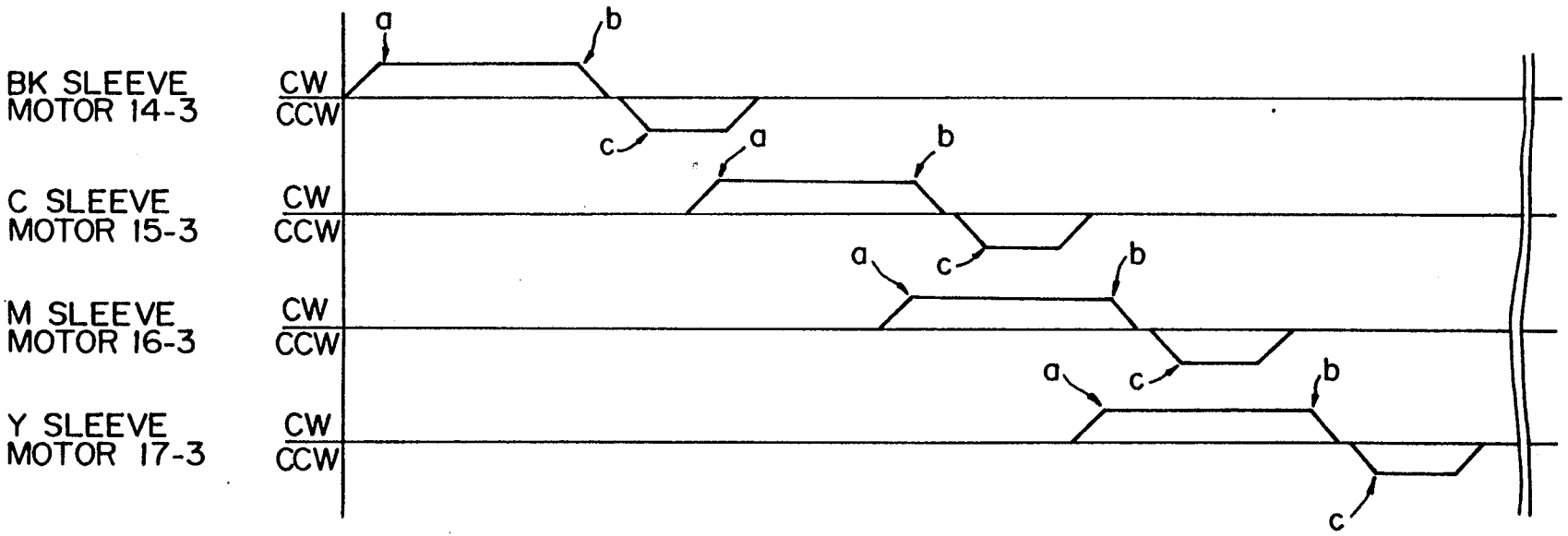
FIG. 5 is a timing chart demonstrating a specific operation of the control system.

As shown in FIG. 5, the BK sleeve 14-1 begins to rotate clockwise before the leading edge of the BK latent image formed on the drum 9 reaches the developing position of the BK developing unit 14. As a result, the BK developer forms a brush at the developing position to develop the BK latent image. Specifically, the BK sleeve 14-1 is driven by the previously mentioned control signal from the motor control board 34. The control signal includes control information for causing the drive current to the motor 14-3 to increase slowly. Consequently, as indicated by a in FIG. 5, the motor 14-3 (as well as the other motors) is slowly accelerated with the result that the load to act on the drum 9 due to the contact of the brush is increased little by little. Thereafter, the BK sleeve 14-1 develops the BK latent image carried on the drum 9.

After the trailing edge of the BK latent image has moved away from the BK developing position, the brush on the sleeve 14-1 is cancelled. Prior to this, the current to the sleeve motor 14-3 is slowly reduced until the BK sleeve 14-1 has been brought to a stop, as indicated by b in FIG. 5. At this instant, although the brush still remains on the sleeve 14-1, the load acting on the drum 9 is prevented from sharply changing due to the slow deceleration of the BK sleeve 14-1.

Even when the rotation of the motor 14-3 is stopped, the brush still exists on the BK sleeve 14-1. To cancel the brush, the BK sleeve 14-1 is reversed, i.e., rotated counterclockwise. Again, the counterclockwise rotation starts slowly to reduce the load acting on the drum 9 little by little, as indicated by c in FIG. 5. Consequently, the rotation speed of the drum 9 changes little.

Figure 6:
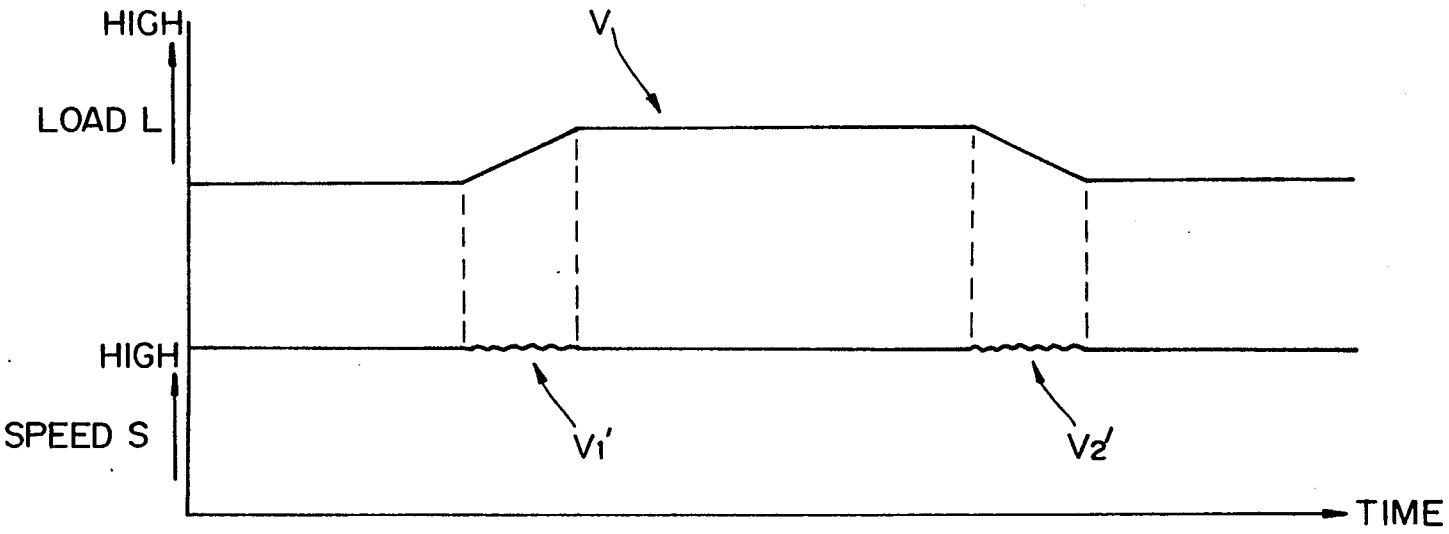
FIG. 6 is a timing chart similar to FIG. 1, showing the effect of control achievable with the embodiment.

As stated above, by starting and stopping the rotation of the sleeve motor slowly, it is possible to cause a load to start and stop acting on the drum 9 slowly. This makes the change in the rotation speed S of the drum 9 negligible, as represented by v'1 and v'2 in FIG. 6. This is successful in eliminating the misregistration of color components, dislocation of an image and so forth and, therefore, in enhancing the image quality.

Increasing and decreasing the current to the motor slowly as described above is a specific implementation for starting and stopping the motor slowly. Alternatively, a flywheel may be mounted on the output shaft of the motor.

In FIG. 5, the slow-down control is also effected when the counterclockwise rotation of the motor ends. This, however, does not constitute essential part of the present invention.

In summary, it will be seen that the present invention provides a color image forming apparatus which eliminates changes in the load on a photoconductive element due to the formation and cancellation of a magnet brush and which would otherwise lower the image quality.

Various modifications will become possible for those skilled in the art after receiving the teachings of the present disclosure without departing from the scope thereof.

What is claimed is:

1. A color image forming apparatus comprising:
an image carrier for electrostatically forming a latent image thereon;
a plurality of developing units each facing said image carrier and storing a developer of particular color; and
drive control means for selectively forming or cancelling a brush of a developer on each of said plurality of developing units by selectively rotating a developing sleeve of the developing unit forward or backward;
said drive control means causing said developing sleeve to accelerate at a substantially constant rate of acceleration when the brush is to be formed on said developing sleeve.

2. A color image forming apparatus according to claim 1, wherein:
said drive control means causes said substantially constant rate of acceleration of said developing sleeve to be a slow rate of acceleration.

3. A color image forming apparatus according to claim 1, wherein:
said drive control means further causes said developing sleeve to decelerate at a substantially constant rate of deceleration when the brush is to be cancelled.

4. A color image forming apparatus according to claim 3, wherein:
said drive control means causes said substantially constant rate of deceleration of said developing sleeve to be a slow rate of deceleration.

5. A color image forming apparatus according to claim 4, wherein:
said drive control means causes said substantially constant rate of acceleration of said developing sleeve to be a slow rate of acceleration.

6. A color image forming apparatus comprising:
an image carrier for electrostatically forming a latent image thereon;
a plurality of developing units each facing said image carrier and storing a developer of particular color; and
drive control means for selectively forming or cancelling a brush of a developer on each of said plurality of developing units by selectively rotating a developing sleeve of the developing unit forward or backward;
said drive control means causing said developing sleeve to slowly stop rotating with the brush existing on said developing sleeve.

7. A color image forming apparatus comprising:
an image carrier for electrostatically forming a latent image thereon;
a plurality of developing units each facing said image carrier and storing a developer of particular color; and
drive control means for selectively forming or cancelling a brush of a developer on each of said plurality of developing units by selectively rotating a developing sleeve of the developing unit forward or backward;
said drive control means causing said developing sleeve to slowly stop rotating when the brush on said developing sleeve is to be cancelled.

8. A color image forming apparatus comprising:
an image carrier for electrostatically forming a latent image thereon;
a plurality of developing units each facing said image carrier and storing a developer of particular color; and
drive control means for selectively forming or cancelling a brush of a developer on each of said plurality of developing units by selectively rotating a developing sleeve of the developing unit forward or backward;
said drive control means causing said developing sleeve to decelerate at a substantially constant rate of deceleration when the brush is to be cancelled.

9. A color image forming apparatus according to claim 8, wherein:
said drive control means causes said substantially constant rate of deceleration of said developing sleeve to be a slow rate of deceleration.

10. An image forming apparatus, comprising:
an image carrier for electrostatically forming a latent image thereon;
a developing unit facing said image carrier and storing a developer; and
drive control means for selectively forming or cancelling a brush of the developer on the developing unit by selectively rotating a developing sleeve of the developing unit forward or backwards;
said drive control means causing said developing sleeve to accelerate at a substantially constant rate of acceleration when the brush is to be formed on said developing sleeve.

11. An image forming apparatus according to claim 10, wherein:
said drive control means causes said substantially constant rate of acceleration of said developing sleeve to be a slow rate of acceleration.

12. An image forming apparatus according to claim 10, wherein:
said drive control means further causes said developing sleeve to decelerate at a substantially constant rate of deceleration when the brush is to be cancelled.

13. An image forming apparatus according to claim 12, wherein:
said drive control means causes said substantially constant rate of deceleration of said developing sleeve to be a slow rate of deceleration.

14. An image forming apparatus according to claim 13, wherein:
said drive control means causes said substantially constant rate of acceleration of said developing sleeve to be a slow rate of acceleration.

15. A color image forming apparatus, comprising:
an image carrier for electrostatically forming a latent image thereon;
a developing unit facing said image carrier and storing a developer; and
drive control means for selectively forming or cancelling a brush of the developer on the developing unit by selectively rotating a developing sleeve of the developing unit forward or backwards;
said drive control means causing said developing unit to decelerate at a substantially constant rate of deceleration when the brush is to be cancelled.

16. A color image forming apparatus according to claim 15, wherein:
said drive control means causes said substantially constant rate of deceleration of said developing sleeve to be a slow rate of deceleration.

* * * * *